US008446326B2

(12) United States Patent
Tietjen

(10) Patent No.: US 8,446,326 B2
(45) Date of Patent: May 21, 2013

(54) FOLDABLE ANTENNA FOR RECONFIGURABLE RADAR SYSTEM

(75) Inventor: Byron W. Tietjen, Baldwinsville, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 605 days.

(21) Appl. No.: 12/109,874

(22) Filed: Apr. 25, 2008

(65) Prior Publication Data

US 2009/0267835 A1 Oct. 29, 2009

(51) Int. Cl.
*H01Q 1/12* (2006.01)
*H01Q 3/02* (2006.01)

(52) U.S. Cl.
USPC ..... 343/757; 343/758; 343/881; 343/882

(58) Field of Classification Search
USPC ..... 343/700 MS, 757, 880, 881, 882, 343/792.5, 758
See application file for complete search history.

(56) References Cited

U.S. PATENT DOCUMENTS 3,249,946 A * 5/1966 Flanagan ..... 343/758
3,595,505 A 7/1971 DiMeo et al.
3,916,416 A 10/1975 Lewis
4,122,453 A 10/1978 Profera
4,617,572 A * 10/1986 Hugo ..... 343/765
4,649,388 A 3/1987 Atlas
4,684,952 A * 8/1987 Munson et al. ..... 343/700 MS
4,792,805 A 12/1988 Miglia
5,115,244 A 5/1992 Freedman et al.
5,227,806 A * 7/1993 Eguchi ..... 343/765
5,642,122 A * 6/1997 Lockie et al. ..... 343/881
5,990,839 A 11/1999 Schefte et al.
6,084,540 A 7/2000 Yu
6,084,545 A 7/2000 Lier et al.
6,111,542 A 8/2000 Day et al.
6,163,296 A 12/2000 Lier et al.
6,255,981 B1 7/2001 Samaniego
6,356,233 B1 3/2002 Miller et al.
6,421,025 B1 7/2002 Drize et al.
6,891,511 B1 5/2005 Angelucci
7,019,712 B2 3/2006 Kanzaki
7,180,447 B1 2/2007 Jacomb-Hood
2007/0001897 A1 1/2007 Alland

OTHER PUBLICATIONS

International Search Report dated Dec. 14, 2009 for related International application No. PCT/US2009/041655.

* cited by examiner

*Primary Examiner* — Michael C Wimer
(74) *Attorney, Agent, or Firm* — Howard IP Law Groupm PC

(57) ABSTRACT

The invention provides for phased array radar system that mechanically reconfigures its antenna array from a single faced aperture into two geometrically opposed arrays.

23 Claims, 5 Drawing Sheets

FOLDABLE ANTENNA FOR RECONFIGURABLE RADAR SYSTEM

FIELD OF INVENTION

The present invention relates generally to radar systems and more specifically to an apparatus for reconfiguring a radar antenna from a single faced full aperture array into at least two half aperture arrays, enabling one or more options regarding range coverage, elevation and pointing direction.

BACKGROUND

The detection and tracking of targets is typically accomplished by a variety of radar systems that analyze the time difference of arrival, Doppler shift, and various other changes in the reflected energy, to determine the location and movement of targets. Phased array antenna systems employ a plurality of individual antenna elements or subarrays of antenna elements that are separately excited to cumulatively produce a transmitted electromagnetic wave that is highly directional. The radiated energy from each of the individual antenna elements or subarrays is of a different phase, respectively, so that an equiphase beam front or cumulative wave front of electromagnetic energy radiating from all of the antenna elements in the array travels in a selected direction. The differences in phase or timing among the antenna activating signals determines the direction in which the cumulative beam from all of the individual antenna elements is transmitted. Analysis of the phases of return beams of electromagnetic energy detected by the individual antennas in the array similarly allows determination of the direction from which a return beam arrives. Such processing as described above is well known to those of ordinary skill in the art.

A pulse based radar system scans a field of view and emits timed pulses of energy. Such radar systems, including, for example, CTA type radar systems, can require both short range and long range target detection and tracking. Long range (e.g. on the order of 60 kilometers (Km) or more) detection performance requires relatively long pulse repetition intervals (PRI). A narrow beam is typically required for long range target detection and tracking.

For CTA radars especially and for full 360° coverage the single array is often rotated at high angular rates to obtain the look opportunities needed for target detection, track, and localization for estimation of launch or impact points. Due to high target vertical velocities, rotation rate, and elevation beam widths, the number of look opportunities is limited.

Usually, the problem of short range detection of a 360° (degree) scanning radar has been solved by rotating a single array phase at a rapid angular rate. One issue with such an approach is that for short range targets, there is no option for increasing coverage other than beam spoiling. This is tends to be less efficient than other methods such as increasing rotation rate, which can create mechanical problems.

A conventional radar array contains a plurality of radiating elements configured to define an array aperture for generating a narrow beam for long range detection and track performance. The longer PRI reduces the probability of detecting high vertical velocity, shorter range targets (e.g. targets within about 15 Km). In order to alleviate this problem, systems may utilize separate short range (SR) and long range (LR) pulses in an attempt to cover all target ranges. However, even with SR pulses, significant limitations exist in conventional radar systems processing and implementation.

For example, short range detection and localization performance of conventional radar systems is typically not limited by target signal-to-noise ratio (SNR), but rather by the number of look opportunities of the target by the radar. This number is limited by such factors as high target vertical velocities, elevation beamwidth, and target revisit rate. More specifically, short range target detection and localization is usually not a function of SNR, because such short range targets typically have SNRs well in excess of typical threshold detection levels. However, a problem lies with the number of look opportunities with which to detect, track and localize a target with sufficient accuracy to evaluate a projectile launch or impact point. A radar system utilizing a narrow beam long range pulse for detecting and tracking targets may operate quite effectively for long range objects; however, such a system may be inadequate to track short range objects having high target vertical velocities, which require much greater processing and response time, but which does not require such narrow beam(s). Alternative techniques for detecting and tracking both long range and short range targets within a single radar system are desired.

The present invention relies in part on recognition of the aforementioned problems, and in providing a solution for enhancing a radar's target coverage without significantly impacting its long range or short range performance. The present invention operates to electrically and mechanically separate a full aperture radar into multiple apertures.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts, and wherein.

DETAILED DESCRIPTION

It is to be understood that the figures and descriptions of the present invention have been simplified to illustrate elements that are relevant for a clear understanding, while eliminating, for the purpose of clarity, many other elements found in radar systems and methods of making and using the same. Those of ordinary skill in the art may recognize that other elements and/or steps may be desirable in implementing the present invention. However, because such elements and steps are well known in the art, and because they do not facilitate a better understanding of the present invention, a discussion of such elements and steps is not provided herein.

High target closure rates due to vertical velocities, scanner rotation rates, and elevation beamwidth, limit the number of detection opportunities in certain types of rotating radar. For CTA radars particularly and for full 360 degree coverage, a single array is often rotated at high angular rates to obtain the look opportunities required for target detection, track, and localization for estimation of launch or impact points from incoming munitions. The invention herein provides for increased performance for a 360 degree rotating radar by at least doubling the number of array faces over a single faced rotating array without impacting the basic system timeline.

Figure 1B:
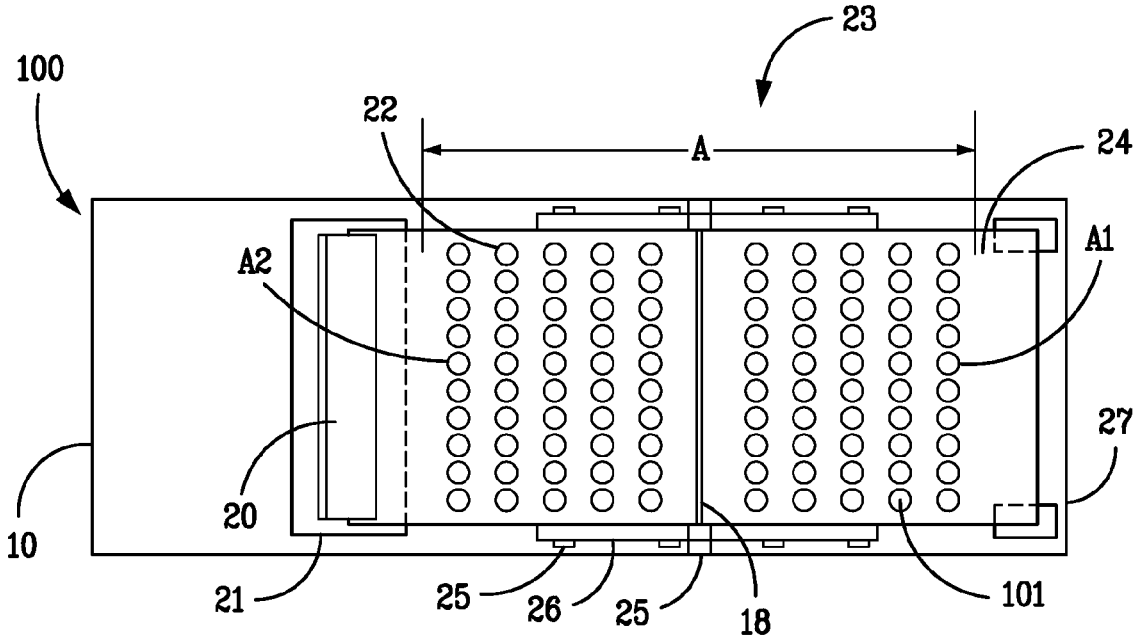
FIG. 1*b* is a top view of a foldable aperture array in a stowed configuration according to an embodiment of the present invention.
Figure 1A:
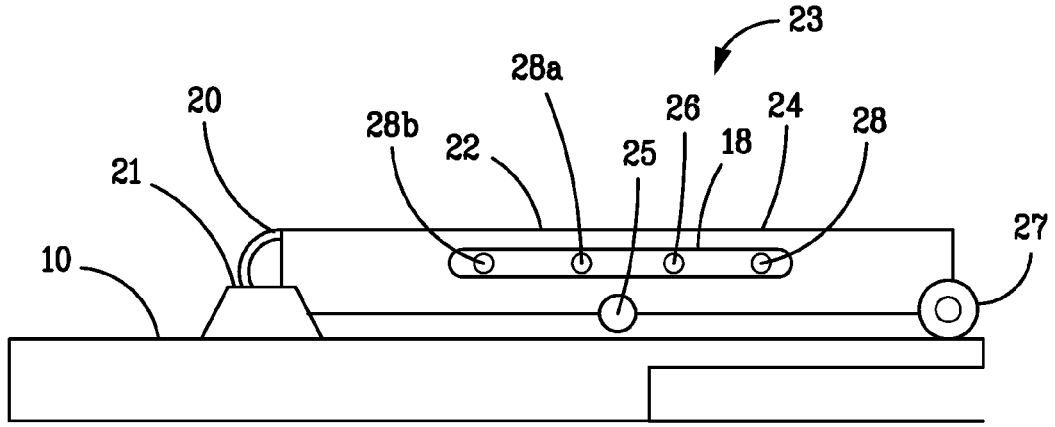
FIG. 1*a* is a side view of a foldable aperture array in a stowed configuration according to an embodiment of the present invention.

Referring now to FIG. 1*a* and FIG. 1*b* there is shown by way of example and not limitation a side view and a plan view, respectively, of a phased array radar system 100 comprising a foldable frame structure designated generally as 23. In an exemplary embodiment, the foldable frame structure comprises a pair of generally planar antenna frames 22, 24 that are joined at respective ends thereof. The frames 22, 24 contain on a side thereof a rectangular array of m×n antenna elements 101 arranged in rows and columns, providing a common aperture A as best shown in FIG. 1*b*. The common aperture A is dividable into sub apertures A1, A2 that correspond to those antenna elements contained on each respective frame 22, 24 (hereafter A and A1, A2 are generally referred to as apertures). A base 10 supports the antenna frame structure 23 through a hinge support member 21, a hinge 20 and a frame support 27. In an exemplary embodiment, locking pins indicated generally as 28 operatively associated with a slideable latch 26 secure the two frames 22, 24 in given relative positions.

The frames 22, 24 are separable along a parting hinge line 18 so that frame 22 and 24 are mechanically moveable through an assembly 25 (e.g. pivot assembly) when the slideable latch 26 is moved (e.g. to the right), thus freeing pins 28*a* and 28*b* to enable the two frames to pivot about the hinge 25. The latchably secured hinge 25 provides for varying the orientation of the planar frames 22, 24 relative to one another and hence one (or more) array apertures in both elevation and pointing direction as further explained below. Additionally, the apertures may be electronically combined in various combinations and independently steerable dependent upon the particular radar application. Those skilled in the art will recognize the mechanical assembly 25 operates to mechanically fold and separate the generally contiguous planar frame structure 23 into two frames 22, 24 and corresponding sub-apertures, in opposing orientation (e.g. different planes), and that other alternative means, manners and methods of latching, locking and releasing each set of sub apertures within the frames 22 and 24 relative to one another are contemplated dependent on the particular application of system 100.

Figure 2:
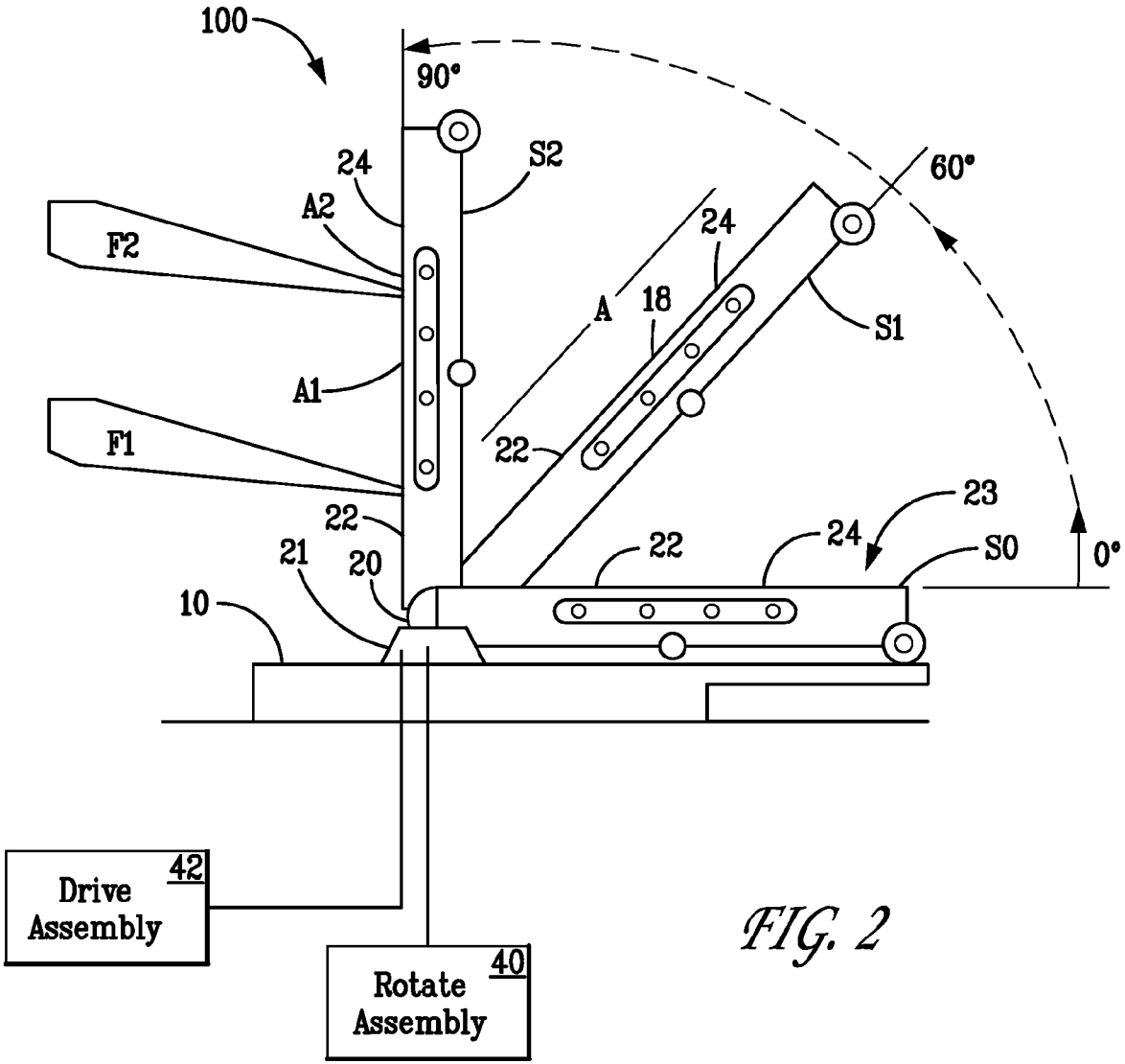
FIG. 2 is a side view of a foldable aperture array illustrated in various elevated positions according to an embodiment of the present invention.
Figure 4:
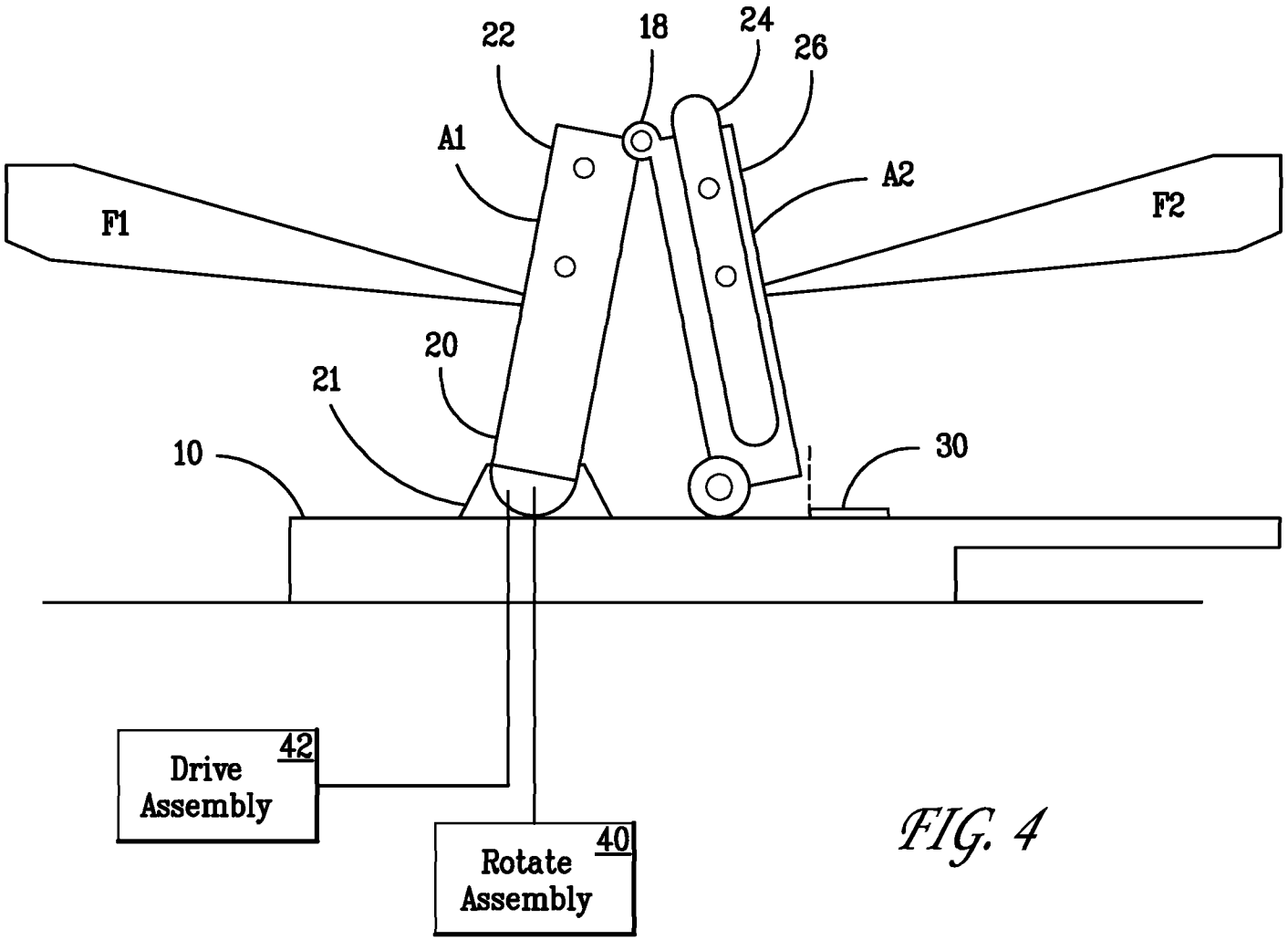
FIG. 4 is a side view of a foldable aperture array erected to operate in an opposed configuration according to an embodiment of the present invention.

Referring now to FIG. 2 there is shown a side view of a phased array antenna system 100 illustrated in several orientations: a stowed stage So, operational stage S1, and operational vertical stage S2. In each of stages So, S1, and S2, the frame structure 23 is positioned so as to be substantially planar whereby the apertures A1, A2 on each of frames 22, 24 may be considered a common or full aperture A. Operational stage S1 shows the full aperture mode being implemented at a given azimuth and elevation and wherein the locked frames 22 and 24 form a single face full aperture mode antenna array. Operational vertical stage S2 is also indicative of the full aperture mode but where the half frames 22 and 24 and hence the entire array is in the vertical position for fixed or rotating operation. Appropriate azimuth and elevation drive assemblies 40, 42 cooperate with the antenna array to provide corresponding direction and orientation of the array. For example, while the S2 state shows the antenna frame in the full vertical upright position, one can understand that the hinge support member 21 may cooperate with frame structure 23 and lift arrangement of drive assembly 42 (e.g. a hydraulic lift) such that the frame structure can be oriented at essentially any angle between the positions of stage S0 and stage S2 as desired. The antenna array can be conventionally rotated about the Z (e.g. vertical) axis by a suitable rotator 40 coupled to the antenna array to enable 360 degree coverage when desired. Mechanisms for rotating an antenna about the vertical or other axis are well know as there are numerous examples of rotating antennas. Such mechanisms may include a rotating platform array on which the antenna is mounted. Other mechanisms may include a rotatable pedestal to which the antenna frame is affixed and so on. Suitable gearing mechanisms for providing rotation of the array are known in the art and are omitted herein for brevity. The rotator 40 may also rotate the antenna array in a folded operational mode as shown in the embodiment of FIG. 4. The wheel 27 can pivot or turn 360° (e.g. as a wheel on a shopping cart or other platform). In one configuration, the wheel 27 can be raised when the foldable antenna is rotated. Those skilled in the art may envision other alternative means, manners and methods of rotating the antenna for a particular application of system 100 in the field.

The phase array antenna system 100 shown in FIG. 2 and illustrated in the folded mode in FIG. 4 also includes antenna frames 22, 24 within which are contained one or more apertures A1, A2, etc. in any combination thereof dependent upon the particular radar application. FIG. 2 includes two representative RF beam patterns F1, F2, each of which point in the same direction from the antenna, as might be desirable when tracking multiple radar targets. RF beam patterns F1, F2, may each be electronically configured for detecting long range targets or each may be electronically configured for detecting short range targets. In FIG. 4, the antenna radiating elements positioned on the foldable frame structure 23 (shown in the positions illustrated in FIG. 2 as a main array of common aperture A, when said frame is positioned in a single plane) are mechanically separated by means of the assembly 25 into sub-apertures A1, A2, of antenna elements, respectively positioned on frames 22, 24. The frames 22, 24 define back-to-back arrays, wherein frame 22 provides aperture A1 less than the common aperture A, and enables antenna radiation in a first direction F1. Frame 24 provides aperture A2 less than the common aperture A, and enables antenna radiation in a second direction F2 opposite the first direction, as illustrated in FIG. 4. It is understood that one of the transmissions such as F1 may also be directed at detecting long range targets and the other transmission such as F2 may be directed at detecting short range targets. Of course, it is also understood that the transmissions from each corresponding frame (e.g. 22, 24) may be both long range, both short range, or a combination of long and short range, according to the transmit and receive electronics. Each of the pairs A1, A2 have directional patterns that include a plurality of sidelobes. Each sidelobe is separated from the adjacent sidelobe, and from any adjacent main lobe, by a null in the antenna or beam pattern. While FIG. 2 shows two beams it is understood that a single beam or multiple beams greater than two can be generated by controlling the radiation patterns emitted by the antenna elements of the array. The formation of various beam patterns from an array of antenna elements is known in the art.

Figure 3B:
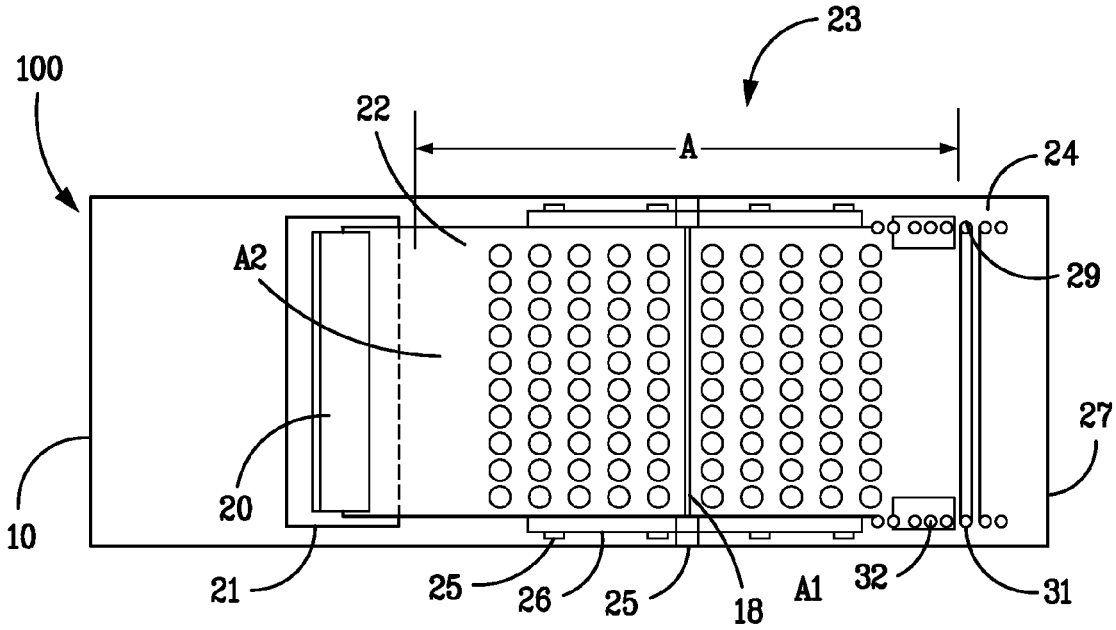
FIG. 3*b* is a plan view of a foldable aperture in an intermediate stage of erection according to an embodiment of the present invention.
Figure 3A:
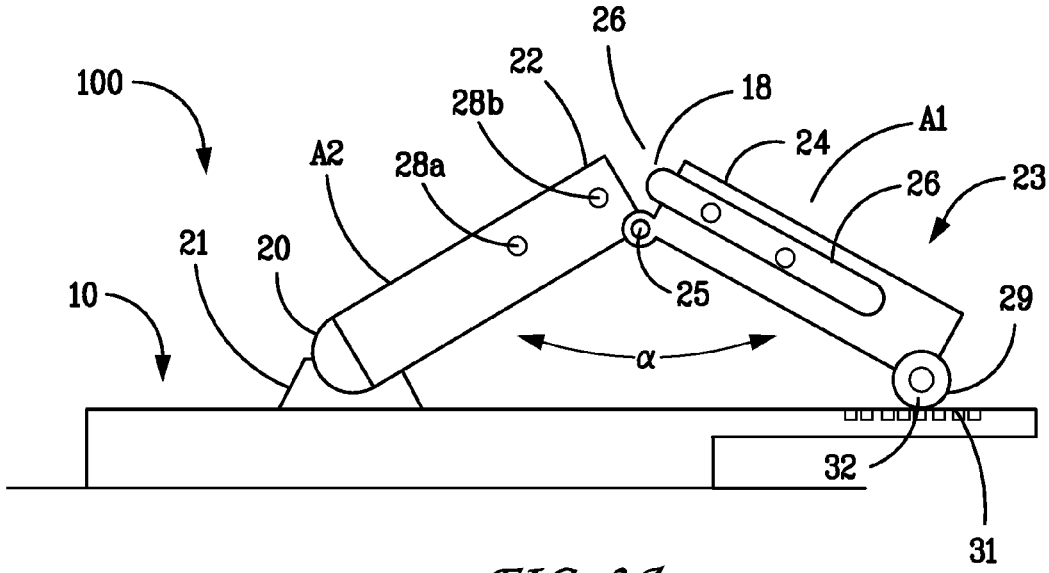
FIG. 3*a* is a side view of a foldable aperture array in an intermediate folding stage of erection according to an embodiment of the present invention.

Referring now to FIG. 3*a* and FIG. 3*b* there is shown by way of example and not limitation a partially elevated side view and a plan view respectively of reconfigurable phase array antenna system 100 having frame structure 23 with aperture A of frames 22, 24 divided into sub apertures A1, A2 whereby the sub aperturs comprise two geometrically opposed and independently steerable phase array antennas. The locking pins 28 operatively associated with a slideable latch 26 securing the two frames 22, 24 are shown moved rightmost freeing locking pins 28*a* and 28*b* allowing frames 22, 24, to rotate along hinge line 18 through pivot assembly 25 and assume complementary positions. In an exemplary embodiment, unlocking the pins 28*a* and 28*b* allows the frames 22, 24 to fold, and to point in opposite directions.

Again referring to FIG. 3*a* and FIG. 3*b*, the elevation angle of apertures A1, A2 are typically held fixed in a position one-half of the supplementary angle by any conventional means such as locking pins and so on. Those skilled in the art will recognize other alternative means, manners and methods of securing the frame members 22 and 24 in position once the position is implemented.

Referring now to FIG. 4 there is shown another side view of phase array antenna system 100 shown in FIG. 3 having been operationally erected to a given operating elevation. Transmission lobes F1 and F2 emanating from apertures A1, A2 comprise substantially one-half of the common aperture A (FIG. 1*b*). The separated frame members 22 and 24 are positioned in an inverted "V" or tent-like configuration. The apex angle of the "V" can vary as desired. The frame halves can be further locked in position by any conventional means, such as a pivotal plate 30 which is horizontal when flush with the platform surface and can be placed in a locking vertical position after the array is folded (dashed line). Many other locking techniques are available and known. The frames 22 and 24 thus contain two geometrically opposed arrays. Each array is one half the full aperture A in size. The two apertures A1, A2, move along hinge line 18 through the pivot assembly 25 and point in opposite directions. The elevation angle of apertures A1, A2 are fixedly oriented in position by any conventional means as locking pins or other restraints.

Thus, as seen above, by utilizing the above-noted technique and therefore by separating both electronically and mechanically a full aperture antenna into, for example, two identical half apertures, one can accomplish efficient short range coverage, which coverage is increased four to one over a single full aperture antenna. The conversion has no impact to the basic time line. This is accomplished by increasing the transmit and receive elevation bandwidths and providing two simultaneous beams instead of one. Thus, the two array faces provide a four to one increase in coverage by widening the transmit and receive beams by two to one and by providing two beams instead of a single beam. This essentially enables one to have a reconfigurable array such that either a single face full aperture array or dual half aperture arrays are readily available. As indicated this is accomplished by separating the full aperture into two identical half apertures and hinging the array at its center such that it could be folded back on itself to form two back-to-back half aperture arrays. By doing this one can keep the number of array elements and the corresponding electronics for each half array exactly the same for either configuration. One can employ a number of simple locking mechanisms to lock the two halves of the arrays together for full aperture operation or to allow the array to fold and be locked in the dual aperture operation, including but not limited to a sliding latch, for example.

Figure 5:
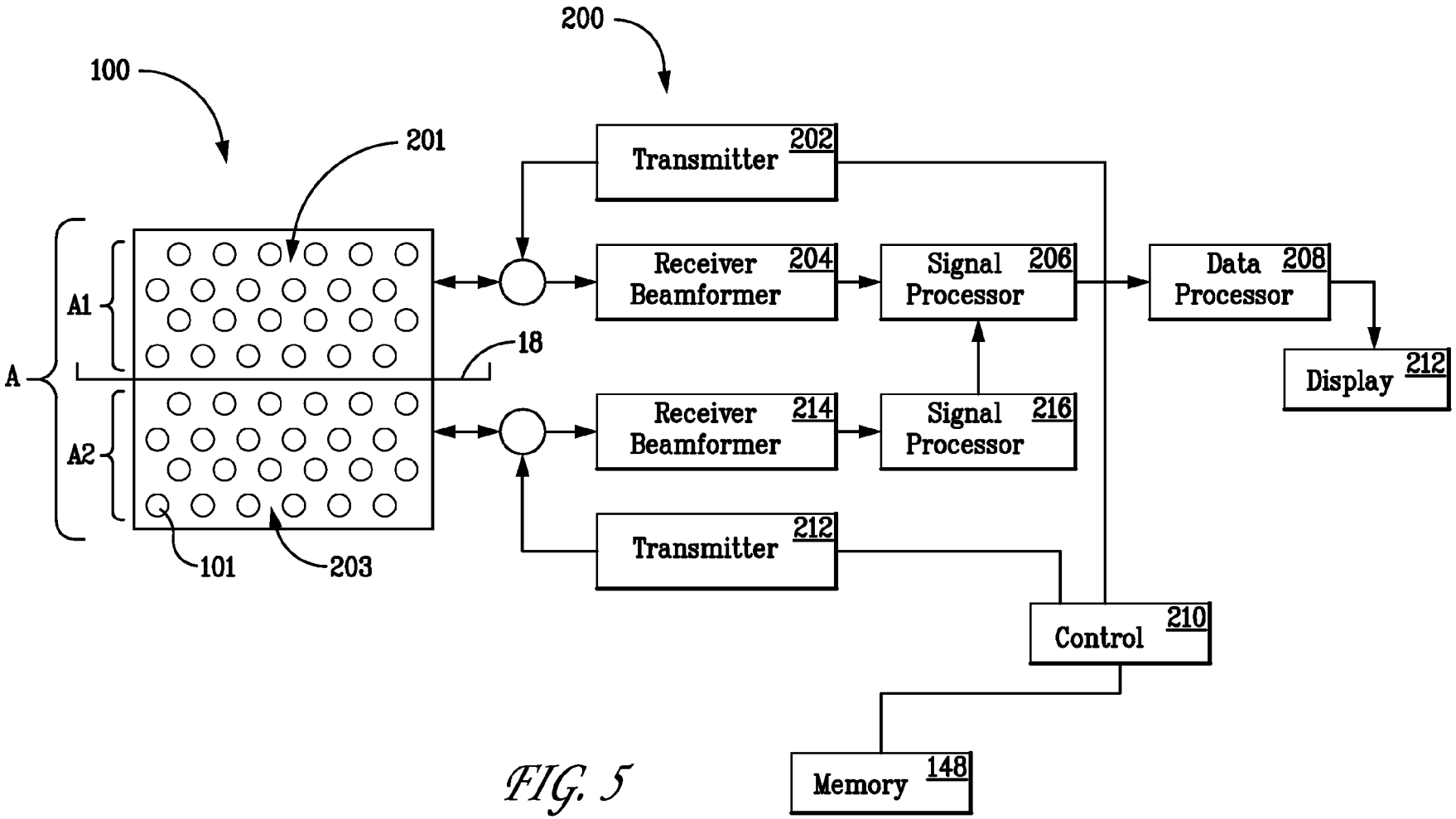
FIG. 5 is a simplified block diagram of a split aperture array configuration useful for target detection and tracking according to an embodiment of the present invention.

Referring now to FIG. 5 there is shown a block diagram of an exemplary split aperture array system 200 for target detection and tracking according to an embodiment of the present invention. System 200 includes a control function module 210 and a processor control logic for generating array control commands for controlling transmit and receive functions of T/R modules or elements 101 in the phased array antenna assembly 100 on a per-element basis. The side view of the phase array antenna system 100 as illustrated in FIG. 4 has apertures A1, A2, each associated with respective transmit/receive (T/R) modules (not shown). Such radiating elements may be dipoles, monopoles, and/or other such radiators as is understood in the art. Each T/R module or element provides the active transmit/receive electronics required to operate the antenna element in transmit and receive mode. In an exemplary embodiment, each T/R module comprises a circulator coupled to a variable attenuator or amplitude shifter via low noise receive amplifier. A phase shifter may be switchably coupled via a T/R switch to transmit to a high power amplifier or to a variable attenuator for operation in either a transmit or receive mode of operation.

It will be appreciated by those skilled in the art that system 200 may be employed in various short range or long range radar applications. By way of example, foldable radar array A1 and A2 in FIG. 4 is used in a short range radar application. The bi-folded apertures A1, A2 have a plurality of radiating elements as depicted in FIG. 5 and designated as 101 configurable in a common array aperture A of m×n elements when the entire frame structure 23 of frames 22, 24 is configured as a single planar member. When the system 200 is to be operated in a short range detection/tracking mode, transmit control commands are generated from control processor 210 and are provided to each of a pair of transmit modules 202, 212 coupled to the array. Each transmit module (202, 212) includes waveform generator and exciter circuitry for electronically separating the common array aperture A of m×n elements into a first sub-aperture A1 comprising a first subset of the m×n elements, and a second sub-aperture A2 comprising a second subset of the m×n elements. In an exemplary embodiment, waveform generator and exciter modules operate to split the array aperture A electronically into two sub arrays of aperture A1 and A2, with A1 and A2 each equal to A/2. That is, sub aperture A1 defines a first subarray 201 of size m/2×n elements, and sub aperture A2 defines a second subarray 203 of size m/2×n elements. Of course, it is understood that each of the subarrays may be segmented into less than one half of the full aperture common array, according to the particular application, mode, and system requirements. The transmitter/exciter circuitry transmits signals to the phased array antenna assembly and hence to each of the subarrays for providing two independently steerable arrays. In a preferred embodiment, the split aperture short range mode provides for two simultaneous beams having twice the beamwidth as that of a single beam formed via the full array aperture A enabling an increase in short range coverage of about 4:1.

Referring again to FIG. 4 in conjunction with FIG. 5, in short range mode the system operates to provide two transmit beams F1, F2, respectively, from sub-arrays 201, 203 simultaneously for short range target detection and tracking. The transmit beams may be broader beams for increased elevation coverage for short range targets such as missiles or other projectiles. The widened beams in elevation are enabled by the high SNR margin associated with short range targets and may effectively increase coverage by a 2 to 1 ratio. The transmit or interrogating beams may differ in at least one of frequency, phase, and beam pointing direction, as controlled by the processor control logic 210. For short range (SR) pulse waveforms the number of search beams is effectively doubled, as twice as many beams effectively double the target revisit rate.

In an exemplary configuration, short range half aperture processing is accomplished using an SR pulse width of about 1 to 10 microseconds (us) with a PRI of about 40 to 100 us. The pulse widths and PRI for each of the beams of the dual apertures A1, A2, would each be of the same duration, but of different frequency and pointing direction, with transmission (and subsequent reception) occurring at the same times for each sub array. In other words, both transmit beams out from apertures A1, A2 would be output at the same time, and both receive beams would be received by the separate beamforming circuits at the same time.

Still referring to FIG. 5, for receive beam processing, reflected signal data is received via each of apertures A1 and A2 and separately processed by receiver circuitry modules 204, 214, respectively. Beamformer signal outputs from each sub-array are down converted via an RF downconverter arrangement, A/D converted into digital form, and applied separately to produce desired beams. The signals representing the various beams are applied to signal processor logic 206, 216 which performs target signal detection and location processing, weight calculations (including, e.g. adaptive weight calculations), antenna nulling, and other signal processing of the received waveforms as is understood by those of ordinary skill in the art. Signal processor logic may be operatively coupled to one or more memory units (not shown) for storing, retrieving and processing array information including calibration data in the form of mutual coupling coefficients, dynamic range and SNR data, transmit power and received signal strength, for example. The beamformer and signal processor modules may also include or be operatively coupled to signal detection circuitry and functionality for detecting and processing the transmitted/received signals, including detection of null conditions and threshold comparisons.

Control Processor 210 may also include or be operatively coupled to performance monitoring and fault detection circuitry for processing and identifying failed or degraded elements for later maintenance or replacement.

The output of signal processor modules 206, 216 are fed into data processor logic 208, 218, which operate to perform target detection and location processing of the target data associated with each of the sub apertures A1, A2, and fed to a display unit 212 for displaying the information to a user.

The beamformer receiver in general provides for the application of phase shifts to each element (via phase shifters), and then sums the result. Further filtering and analog to digital (A/D) conversion may also be included. The signal processor will operate on this digital data to further filter the signal as needed, perform pulse compression, Doppler filtering, magnitude detection, and thresholding for target detection as is well known to those skilled in the art. The data processor coupled to the signal processor will use this target detection data to form trackers which track the targets and determine target characteristics, such as trajectory, and launch and/or impact points as is well known to those skilled in the art. The control processor 210 serves to coordinate the full and half aperture modes by providing the appropriate control functions to the array elements and the transmit/receive processing. This will include the proper phase shifts to each element during transmit and receive when transmitting and receiving the full aperture (long range) pulse or sub-aperture (short range) pulse as is understood by those skilled in the art.

The separately controlled arrays and separate receiver processing enable partial aperture (i.e. A1, A2) performance to be obtained. In a preferred embodiment, different transmit beam frequencies are utilized for each sub-aperture.

The processor, memory and operating system with functionality selection capabilities can be implemented in software, hardware, firmware, or a combination thereof. In a preferred embodiment, the processor functionality selection is implemented in software stored in the memory. It is to be appreciated that, where the functionality selection is implemented in either software, firmware, or both, the processing instructions can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions.

Referring now to FIG. 2 in conjunction with FIGS. 3*a* and 4, in an exemplary operation, an antenna system 100 comprising planar frame structure 23 is initiated from the stowed stage So (FIG. 2) wherein frames 22, 24 are aligned with one another as shown. The frame structure is reconfigured from stage So to a different position in elevation in accordance with commands and control information from drive circuitry 42. For operation in a folded configuration, command and control information from drive circuitry 42 may be used to control the assembly 25 so as to mechanically fold and separate frames 22, 24 from that of a single planar structure (as shown in FIG. 2) to dual antenna arrays (apertures A1, A2) having opposing orientations as depicted in FIG. 3*a* and FIG. 4. Once the array is positioned at the desired angle/elevation, control information may be provided via drive circuitry 42 to lock the array in place. The array may be rotated by means of control circuitry 40 and the arrays A1, A2 shown in the folded mode in FIG. 4 operated in accordance with transmit and receive circuitry to generate beams F1, F2 for short range and/or long range target detection and tracking, as for example illustrated in FIG. 5. Frame 22 thus provides a first aperture A1 less than the given or common aperture A (FIG. 2) to enable antenna radiation in a first direction and the second frame 24 provides a second aperture A2 also less than aperture A. In an exemplary embodiment, the antenna elements for each of frames 22, 24 are equal in number with each being one half of the total and where apertures A1, A2 are each one-half of the given aperture.

It is understood the program storage medium that constrains operation of the associated processors(s), and the method steps that are undertaken by cooperative operation of the processor(s) on the messages within the communications network. These processes may exist in a variety of forms having elements that are more or less active or passive. For example, they exist as software program(s) comprised of program instructions in source code or object code, executable code or other formats. Any of the above may be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), flash memory, and magnetic or optical disks or tapes. Exemplary computer readable signals, whether modulated using a carrier or not, are signals that a computer system hosting or running the computer program may be configured to access, including signals downloaded through the Internet or other networks. Examples of the foregoing include distribution of the program(s) on a CD ROM or via Internet download.

The same is true of computer networks in general. In the form of processes and apparatus implemented by digital processors, the associated programming medium and computer program code is loaded into and executed by a processor, or may be referenced by a processor that is otherwise programmed, so as to constrain operations of the processor and/or other peripheral elements that cooperate with the processor. Due to such programming, the processor or computer becomes an apparatus that practices the method of the invention as well as an embodiment thereof. When implemented on a general-purpose processor, the computer program code segments configure the processor to create specific logic circuits. Such variations in the nature of the program carrying medium, and in the different configurations by which computational and control and switching elements can be coupled operationally, are all within the scope of the present invention.

As shown and described herein, the present invention also provides for long range detection and localization performance of a full aperture array A while providing a 4:1 increase in target coverage for short range targets or projectiles. The present invention takes advantage of the SNR margin for short range targets and widens transmit and receive beams in elevation to increase coverage by 2:1 in short range mode, while doubling the number of search beams for short range waveforms, thereby quadrupling short range target coverage. By implementing the split aperture parallel processing configuration and SR waveform pulses for short range detection/track, and long range coherent narrow band single beam processing configuration for LR waveform pulses and long range detection/track, baseline templates are not impacted, while providing twice the number of short range beams in the same amount of time. The increased coverage for SR targets will also allow more track-while-scan processing to avoid impact to the timeline by reducing the number of dedicated track beams necessary to verify/track targets.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A reconfigurable phased array radar system, comprising:

a base, a plurality of antenna radiating elements positioned on a foldable frame in a main array, said main array having a given aperture when said frame is positioned in a single plane, an assembly positioned on said frame to mechanically fold and separate into a first frame portion having a first plurality of said elements thereon defining a first sub-array and a second frame portion having a second plurality of said elements thereon defining a second sub-array, said first frame portion rotatably connected to said base via a coupling and provides a first aperture less than said given aperture to enable antenna radiation in a first direction and said second frame portion provides a second aperture also less than said given aperture to enable radiation in a second direction, and wherein rotating said first frame portion with respect to said base via said coupling in a first mode, causes the elevation angle of the main array to be altered with respect to said base while maintaining said frame in a single plane, and in a second mode, causes said frame to be folded and separated into said first frame portion and said second frame portion.

2. The reconfigurable phased array radar system according to claim 1, wherein, said first and second pluralities of antenna elements are equal in number with each plurality being one half of said given plurality, with said first and second apertures being one-half of said given aperture.

3. The reconfigurable phased array radar system according to claim 1, wherein said assembly comprises a hinge member positioned centrally on said frame to fold said frame into an inverted "V" shape, wherein said first and second apertures face opposite directions.

4. The reconfigurable phased array radar system according to claim 3, further including means coupled to said frame to lock said frame in said folded position.

5. The reconfigurable phased array radar system according to claim 1, wherein said first and second pluralities of antenna elements are unequal in number, providing first and second unequal antenna apertures.

6. The reconfigurable phased array radar system according to claim 1, wherein said first and second apertures are coupled to electronic means for independently steering said sub-apertures.

7. The reconfigurable phased array radar system according to claim 1, further comprising a rotating assembly coupled to said frame for rotating said foldable frame.

8. The reconfigurable phased array radar system according to claim 1, wherein said back-to-back arrays are adapted for short range target detection.

9. The reconfigurable phased array radar system according to claim 1, wherein said main array is adapted for long range target detection.

10. The reconfigurable phased array radar system according to claim 1, wherein the elevation angle of the main array may be altered between a generally vertical orientation and a generally horizontal orientation while maintaining said frame in said single plane.

11. The reconfigurable phased array radar system according to claim 1, wherein the elevation angle of the main array may be altered while maintaining said frame in said single plane by a drive assembly.

12. A reconfigurable phased array radar system comprising:

a base, a latchably secured hinged antenna frame having a first portion pivotally connected to said base by a coupling and a second portion hingedly connected to said first portion, said frame having an assembly for varying the elevation and directional orientation of one or more array apertures contained therein and which apertures are electronically combined and independently steered for detecting one or more targets, said antenna frame operative in a first mode wherein said first and second portions are arranged as a single face antenna array aperture when said frame is positioned in a single plane, and in a second mode as a dual faced multi-aperture antenna array, wherein the elevation angle of said antenna frame in the first mode may be altered with respect to said base by pivoting said first portion via said coupling while maintaining said frame as said single face antenna array in a single plane, and wherein when in the second mode, pivoting said first portion via said coupling alters the orientation of said second portion with respect to said first portion.

13. The system of claim 12, wherein the at least two apertures are geometrically opposed.

14. The system of claim 12, wherein the system is rotable through 360° degrees.

15. The system of claim 12, wherein in said second mode, said frame is operated to fold at a hinge when a latch is operated to cause said frame to be positioned in an inverted "V" configuration, wherein one array associated with one folded portion of said frame provides an aperture which is one half of said single faced aperture and with said other folded portion providing another aperture which is also one half of said single faced aperture.

16. A method for reconfiguring a phased array radar system, comprising the steps of:

placing a plurality of antenna elements on a frame having a hinge which enables said frame to fold, positioning said frame in a vertical direction by pivoting said frame with respect to a base about a coupling, energizing said elements to cause said array to emit a radiation pattern for tracking long range targets, said vertical antenna array being a full aperture array, folding said frame about said hinge by pivoting at least a portion of said frame about said coupling to cause said frame to assume an inverted "V" configuration with a first plurality of said elements located on a first folded frame portion and a second plurality of elements located on a second folded frame portion, energizing said first and second plurality of elements to cause said elements to emit at least a radiation pattern from said first folded portion and a second radiation pattern from said second folded portion for tracking short range targets.

17. The method according to claim 16, further including the step of placing said hinge on said frame relatively at the center of said frame to separate said frame into relatively equal first and second portions, each portion having the same number of antenna elements to thereby provide two geometrically opposed arrays, each of which is one half the full array aperture.

18. A reconfigurable phased array antenna system comprising:

a base, a foldable frame pivotally attached to said base via a coupling having positioned thereon a plurality of radiating elements which when energized when said frame is not folded provide a radiation pattern with said radiating elements forming a single face aperture antenna, and means coupled to said frame for selectively securing said foldable frame in an unfolded position, thereby forming said single face aperture, and selectively permitting folding said single face aperture into two geometrically opposed apertures, each geometrically opposed aperture smaller than said single face aperture, wherein pivoting said frame via said coupling alters the elevation angle of said single face aperture antenna with respect to said base when said frame is secured in the unfolded position, and wherein pivoting said frame via said coupling folds said single face aperture into said two geometrically opposed apertures when said frame is not secured in the unfolded position.

19. The reconfigurable phased array radar system according to claim 18, wherein said means includes a fold line positioned near the center of said frame to separate said frame into a first and a second portion, a hinge joining said first and second portions at said fold line to enable said frame to assume a generally inverted "V" configuration, one of said two geometrically opposed apertures associated with one of said first and second frame portions, and the other one of said two geometrically opposed apertures associated with the other one of said first and second frame portions.

20. The array according to claim 18, further including means coupled to said frame for rotating the same about a vertical axis.

21. A reconfigurable antenna comprising:

a base;

a radar array having a single faced aperture and a mechanical assembly coupled to said array to reconfigure said single faced aperture into two geometrically opposed apertures, the mechanical assembly comprising:

a first frame portion pivotally attached to said base on a first end thereof, and a second frame portion having a first end pivotally coupled to a second end of said first frame portion about a common pivoting axis and movably supported on a second end thereof by a surface of said base when said single faced aperture is configured as two geometrically opposed apertures, wherein said single faced aperture is movable between a plurality of elevation angles with respect to said base, and wherein reconfiguring said single faced aperture into two geometrically opposed apertures alters the position of said common pivoting axis with respect to said base.

22. The reconfigurable antenna according to claim 21, wherein each geometrically opposed aperture is one half said single faced aperture in size.

23. The reconfigurable antenna according to claim 21, wherein said base comprises a planar surface along which said second end of said second frame portion is moveably supported.

* * * * *